US007089895B2

(12) United States Patent
Naber et al.

(10) Patent No.: US 7,089,895 B2
(45) Date of Patent: Aug. 15, 2006

(54) VALVE OPERATION IN AN INTERNAL COMBUSTION ENGINE

(75) Inventors: Jeffrey D. Naber, Houghton, MI (US); Robert W. Deutsch, Sugar Grove, IL (US); David Frankowski, Monroe, MI (US); Monroe Goble, Wyandotte, MI (US); Steven L. Plee, Brighton, MI (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/035,194

(22) Filed: Jan. 13, 2005

(65) Prior Publication Data

US 2006/0150932 A1 Jul. 13, 2006

(51) Int. Cl.
*F01L 9/04* (2006.01)

(52) U.S. Cl. ..... 123/90.11; 251/129.01; 251/129.15; 251/129.16

(58) Field of Classification Search ..... 123/90.11; 251/129.01, 129.15, 129.16
See application file for complete search history.

(56) References Cited

U.S. PATENT DOCUMENTS 5,022,357 A 6/1991 Kawamura
6,167,852 B1 * 1/2001 Kamimaru et al. ..... 123/90.11
6,192,841 B1 2/2001 Vorih et al.
6,349,685 B1 2/2002 Kolmanovsky et al.
6,371,064 B1 4/2002 Hartke et al.
6,374,813 B1 4/2002 Iida et al.
6,536,389 B1 3/2003 Shelby et al.
6,571,823 B1 6/2003 Rossi et al.
6,588,385 B1 7/2003 Fuwa
6,591,204 B1 7/2003 Rossi
2002/0117132 A1 8/2002 D'Alpaos et al.
2002/0163329 A1 11/2002 D'Alpaos et al.
2003/0140875 A1 7/2003 Panciroli et al.

FOREIGN PATENT DOCUMENTS

EP 1 101 015 B1 5/2000
EP 1 101 016 B1 5/2000

* cited by examiner

*Primary Examiner*—Thomas Denion
*Assistant Examiner*—Zelalem Eshete
(74) *Attorney, Agent, or Firm*—Brian M. Mancini; Terri S. Hughes

(57) ABSTRACT

An apparatus and method for operating a plurality of valves in an engine uses valve actuators to move each valve. Accelerometers are used to detect acceleration of the valves and particularly the moment when they seat. A knock sensor detects an acoustic impulse made by the valves when they seat. A controller correlates signals from the sensor and accelerometers, wherein a signal from the sensor that correlates in time with a signal from an accelerometer indicates seating of the respective valve, which indicates a closure of the respective valve. The controller measures a magnitude of the acoustic impulse to be used as feedback in controlling the operation of the respective valve actuator, and provide softer landings of the valve.

19 Claims, 4 Drawing Sheets

| 3.0L V6 | | |
|---|---|---|
| RUN No. | RET. | ADV. |
| WIN START | 30 | 0 |
| WIN STOP | 60 | 30 |
| HIGH PASS | 500 | 500 |
| LOW PASS | 4000 | 4000 |
| ACC No. | 4 | 4 |
| VALVE | INTAKE | INTAKE |
| CYL. 1 MEAN | 47.0852 | 17.2845 |
| CYL. 1 STD. | 0.4722 | 0.1694 |

| 4.6L V8 | | |
|---|---|---|
| RUN No. | RET. | ADV. |
| WIN START | 80 | 70 |
| WIN STOP | 100 | 90 |
| HIGH PASS | 500 | 500 |
| LOW PASS | 4000 | 4000 |
| ACC No. | 5 | 5 |
| VALVE | INTAKE | INTAKE |
| CYL. 1 MEAN | 97 | 78 |
| CYL. 2 MEAN | 97 | 78 |
| CYL. 3 MEAN | 97 | 78 |
| CYL. 4 MEAN | 97 | 78 |
| CYL. 5 MEAN | 97 | 78 |
| CYL. 6 MEAN | 97 | 78 |
| CYL. 7 MEAN | 97 | 78 |
| CYL. 8 MEAN | 97 | 78 |
| | | |
| CYL. 1 STD. | 0.11 | 0.1 |
| CYL. 2 STD. | 0.22 | 0.13 |
| CYL. 3 STD. | 0.14 | 0.11 |
| CYL. 4 STD. | 0.08 | 0.08 |
| CYL. 5 STD. | 0.14 | 0.14 |
| CYL. 6 STD. | 0.09 | 0.1 |
| CYL. 7 STD. | 0.07 | 0.1 |
| CYL. 8 STD. | 0.12 | 0.11 |

VALVE OPERATION IN AN INTERNAL COMBUSTION ENGINE

FIELD OF THE INVENTION

The present invention relates generally to operating valves on an internal combustion engine. More specifically, the invention relates to a technique for reducing valve noise during engine operation.

BACKGROUND OF THE DISCLOSURE

The trend in internal combustion engines is to increase efficiency. This has necessitated a move away from engines with fixed, cammed timing towards engines with variable timing, such as is available in camless engines. Instead of the mechanical or mechanical-hydraulic valve train systems of cammed engines, camless engines can use an Electronic Valve Actuator (EVA) and Electro-Hydraulic Valve Actuator (EHA) to operate valves with almost any timing imaginable. However, such electrically dependant valve actuator systems present problems with closure detection and soft landing control. The use of EVA and EHA systems require control and diagnostics of the impact velocity and closure time of the valves. This is required for valve durability, air flow control, and noise, vibration and harshness (NVH) performance.

Impediments to higher volume application of electrically driven (EVA) and electrically actuated and hydraulically driven (EHA) systems is its relatively high system cost. One of the factors causing this high cost is the requirement for closed loop correction of the actuator and using one proximity sensor per actuator. In addition, the support systems for these individual sensors further increase cost because of the number of connectors, wiring, control blocks, integration, etc. required with this approach.

What is needed is lower cost approach for detecting valve closure and operating EHA and EVA valve actuators. In particular, it would be of benefit to provide an apparatus and method of using indirect measurements of valve closure and measuring movements of multiple actuators along with control and diagnostic methods using these measurements.

BRIEF DESCRIPTION OF THE DRAWINGS

The features of the present invention, which are believed to be novel, are set forth with particularity in the appended claims. The invention, together with further objects and advantages thereof, may best be understood by making reference to the following description, taken in conjunction with the accompanying drawings, in the several figures of which like reference numerals identify identical elements, wherein:

DETAILED DESCRIPTION OF EMBODIMENTS OF THE INVENTION

The present invention describes an apparatus and method of using a single indirect measurement of closure for a plurality of valves, along with a low cost sensor per actuator to measure valve movement, along with control and diagnostic techniques using these measurements. In this way, the present invention provides a lower cost approach for detecting valve closure and operating EHA and EVA valve actuators in a camless internal combustion engine.

In the example below an electrically driven valve actuator will be described, wherein an electromagnetic field is used for opening and closing a valve. Intake and exhaust valves are substantially identical in construction, and the present invention is applicable to both. In addition, multiple intake or exhaust valves can be accommodated per each cylinder.

Figure 1:
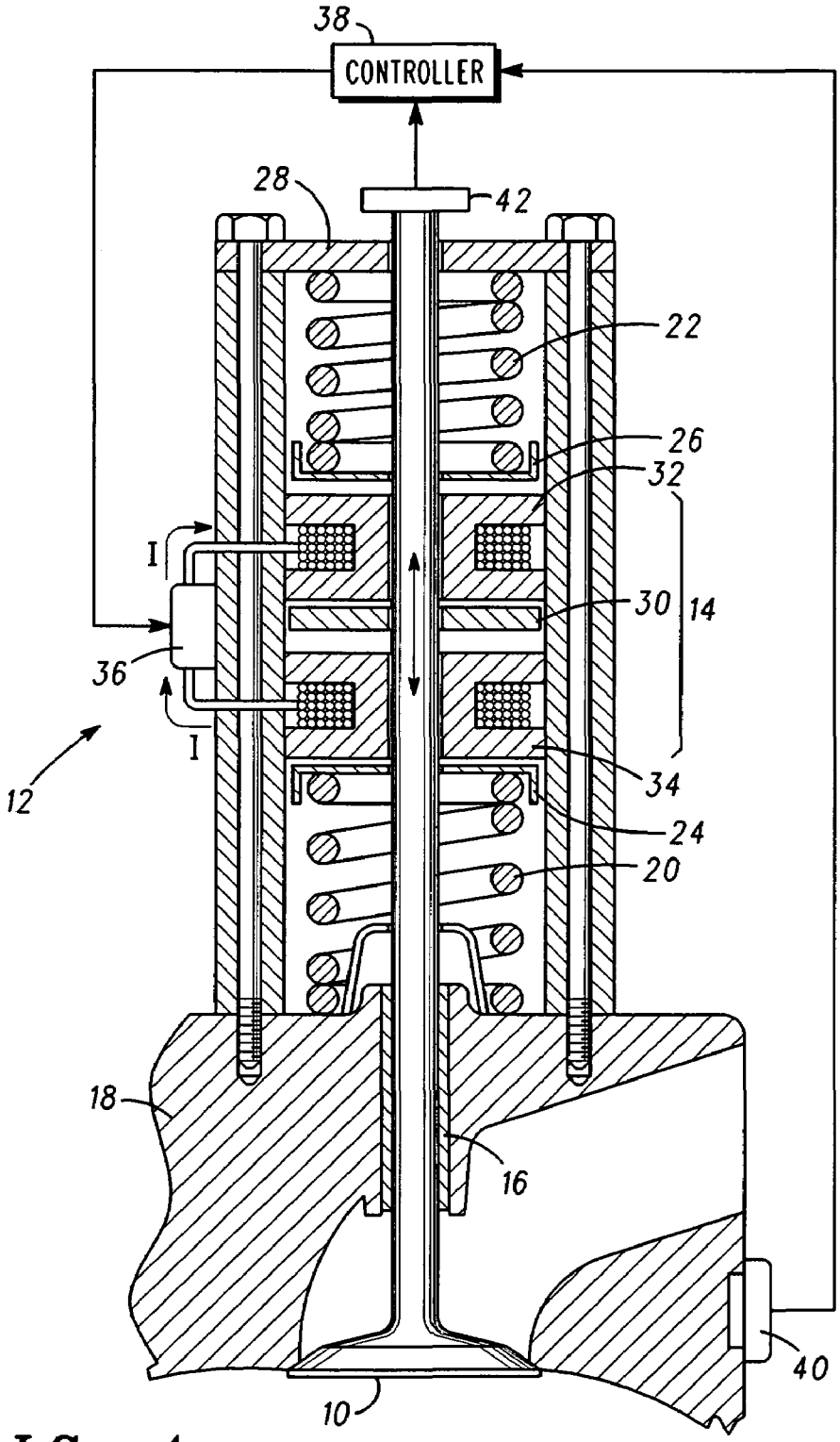
FIG. 1 shows a cross-sectional view of a valve actuation apparatus, in accordance with the present invention.

Referring to FIG. 1, a valve 10 is shown coupled with a valve actuator 12. An electromagnetic solenoid 14 is provided in the valve actuator 12. The solenoid is operable to move the valve 10 in an upward or downward position, depending upon its polarity. The valve 10 is slip fit in a valve guide 16 installed in a cylinder head 18. The valve acts against two springs 20, 22 as it moves upward or downward, wherein the springs are always under some amount of compression. The valve 10 is shown in the closed position wherein one spring 22 is under more compression than the other spring 20.

A lower spring retainer 24 is fixed to the valve 10 and is used to contain the first spring 20 against the cylinder head 18, wherein the spring 20 provides a force to close the valve 10. An upper spring retainer 26 is fixed to the valve 10 and is used to contain the second spring 22 against a cap 28 that is fixed in relation to the cylinder head 18, wherein the spring 22 provides a force to open the valve 10.

The solenoid 14 has an armature 30 made of a high-magnetic-permeability material that is fixed to the valve 10. Fixed electromagnetic coils 32, 34 are positioned above and below the armature 30, and are used to drive the armature 30 therebetween. The electromagnetic coils 32, 34 have sufficient force to assist the springs 20, 22 in fully opening or closing the valve 10. A solenoid driver 36 can be used to supply power to the coils 32, 34, under control of a controller 38.

In operation, the controller 38 can signal the driver 36 to supply current to the coils 32, 34 to drive the armature 30, and subsequently the valve 10, in an upwards or downwards motion. Preferably, the controller provides a variable signal such that the valve opens or closes in a controlled manner (i.e. at a controlled variable velocity). The signal can be an analog or digital signal for interpretation by the driver. The electrical operation of the actuator 12 is known in the art and will not be presented here for the sake of brevity. In addition, the operation of an electro-hydraulic actuator is also known in the art, and can be used in a corresponding manner in the present invention.

Although the apparatus as shown is symmetrical there are instances when the opening force and closing force will be different, necessitating an asymmetrical actuator configuration. For example, an exhaust valve will require a very large opening force, which will change with engine conditions and timing, to open the valve against a large cylinder pressure after a combustion stroke, whereas the closing force will be much less. An intake valve will generally have substantially equal opening and closing forces. Due to the variability in conditions and timing, there can be a problem with the valve seating against the head too harshly causing undesirable noise and vibration. In addition, the large forces involved in the engine, high currents driving the actuator, and the movement of components within the valve actuator, cause an environment of high noise in the vicinity of the valve.

The present invention solves this problem by providing redundant sensing means to detect valve closure and to adjust closure as needed to reduce noise and vibration. A sensor 40, such as an acoustic sensor, is used to detect the acoustic impulse made by the valve 10 upon seating (closure). In practice, the acoustic sensor 40 is an accelerometer mounted on the block or head 18 of an internal combustion engine to perform the measurement of the magnitude of the valve closing impact via measure of transmitted vibrations for EVA and EHA applications, in accordance with the present invention. Typically, these measurements are used as inputs for monitoring control for EVA and EHA systems by the controller 38. Preferably, a common and relatively inexpensive accelerometer, such as the ones currently used for combustion knock detection, can be used for determining valve closing time and valve closing velocity, thereby saving an extra cost. In practice, to help discriminate from extraneous noise, the sensor 40 should be located in proximity to the engine valves and away from other noise sources. Therefore, in the example of a V8 engine, it may be necessary to use two acoustic sensors, one for each bank of cylinders.

An accelerometer 42 is disposed on each of the (EVA or EHA) actuators. For example, the accelerometer 42 can be coupled to the valve itself 10 (as shown), springs 20,22, armature 30, or any available part of the valve actuator 12. Any of these are acceptable since these devices are mechanically coupled in motion. For best response it is preferable to mount the accelerometer 42 to the valve itself 10. However, there may be temperature, manufacturing, or assembly issues that might make this impractical. The accelerometer 42 is operable to detect movement of the valve 10, and in particular when the valve 10 stops moving (valve closure). Although the valve also stops moving when the valve 10 is fully open, this open position would not provide an acceleration signal as large as when the valve makes an abrupt stop upon closing. In addition, the knock sensor 40 would not detect an acoustic signal upon the valve opening, but only upon seating. The present invention takes advantage of this by correlating the signal from the knock sensor 40 and the accelerometer 42 in the controller 38 to confirm a valve closure, wherein a signal from the sensor 40 that correlates in time with a signal from the accelerometer 42 indicates a seating of the valve 10 associated with that particular accelerometer. Moreover, the use of multiple accelerometers with only one knock sensor is sufficient to detect closure of any valve. In addition, simultaneous closure of multiple valves can also be detected as will be detailed below.

Figure 2:
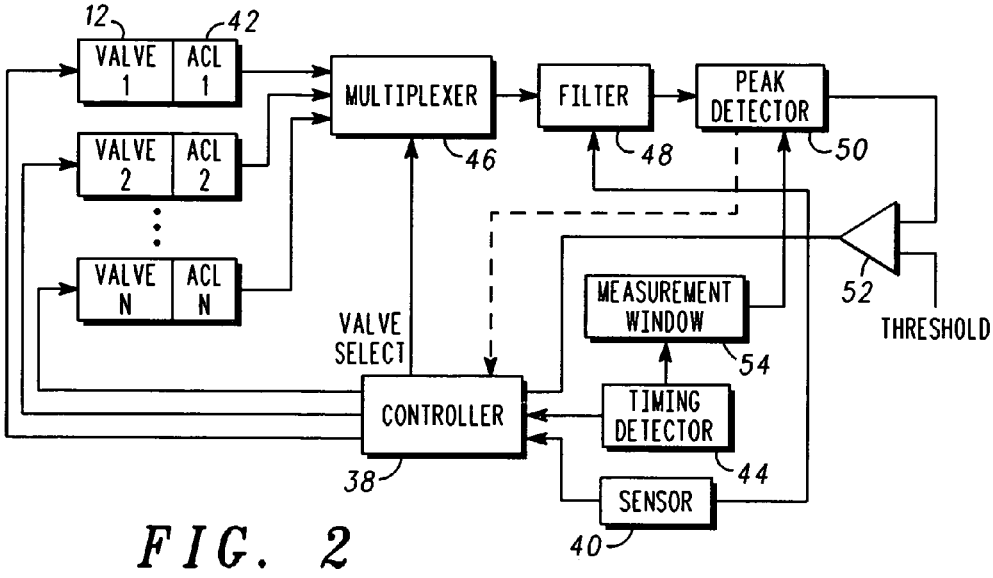
FIG. 2 shows a schematic diagram of a circuit for controlling valves, in accordance with the present invention.

Referring to FIG. 2, in a preferred embodiment, the apparatus further includes a timing detector 44 that is used to decide when correlation of the signals from the sensor 40 and any accelerometer 42 is performed. For example, the timing detector 44 can provide a timing window about a predetermined point when a particular valve is to seat. The timing detector can typically be a crankshaft position sensor, or can be generated by a controller 38. Timing of the engine is used to estimate a valve impact for windowing the measurements of the accelerometer(s) signals. In this way, a particular valve closure is only detected during the time when it can actually be measured, thereby reducing problems from false detections, due to extraneous noise for example. Using the indirect measurement of an accelerometer 42 for valve closure recognition, located at the correct timing position for closure from the timing detector 44, provides precise windows of detection to enable the measurement of the harshness of any particular valve closure by the acoustic sensor 40. In practice, the controller 38 can correlate the signals to confirm a true valve closure, obtain the magnitude of the acoustic impulse of the closure, and use the magnitude as feedback to modify the valve actuation control to provide a softer closure (i.e. reduced impact velocity), thereby mitigating NVH problems.

In practice, the accelerometer(s) signals are windowed by a multiplexer 46, and can be filtered 48. Signal peaks are then determined in a peak detector 50. Any signal peaks about a threshold, as determined by a comparator 52, are indicative of a valve closure that is too harsh. Alternatively, the controller 38 can compare the peak values to a threshold directly, without the need for a separate comparator 52. The peak values along with timing data 44 (e.g. crankshaft encoder data) are used to determine location (crankshaft angle) of valve impact. A combination of the accelerometer(s) magnitude and signal energy is used to determine impact velocity. Impact velocity can be estimated and the requirements for subsequent soft landing can be determined by the controller 38. Thereafter, the controller can decrease the rate of movement (velocity) of the valve at the point of seating to reduce the magnitude of the acoustic impulse therefrom to below the threshold level.

Optionally, the controller can measure a characteristic frequency of the acoustic impulse to further discriminate a valve seating from extraneous noise. Further, where two valve closures overlap, either the energy (magnitude) of the signal will increase (compared to a single valve or due to a location relative to the accelerometer) or the frequency of the signals will be different, due to differences in structure around the valve seat and differences in location relative to the sensor 40, which can be identified by the controller. The valve closing timing information would be an input to the valve actuation control algorithm in the controller 38 to control the next closing event and window for valve closure detection of the appropriate valve 10.

Since an energy of the valve closing signal can be measured, this energy can be used as an input for soft landing control of the actuator. The magnitude of the valve closing signal measures how hard the valve landed for this closure event and can be used to precisely control the actuator current to optimize how hard the valve lands for next closure event. Further, this signal can be combined with an open loop speed/load function to provide a closed loop functionality. The information provided by the above described techniques can also be used to perform diagnostics on the actuator/driver when the results do not meet expected criteria.

FIG. 2 shows a specific embodiment of the present invention to provide signal conditioning for the accelerometers and for determination of location of valve closure (CA_VC) and valve closing energy. One or more of the signal conditioning blocks 48, 50, 52 may be used depending upon the number of cylinders, number of valves, number of sensors, which sensors are mapped to which cylinder and possible overlap in time/crank angle of valve closing events.

The engine controller or valve controller 38 performs the close loop control and diagnostics of the individual EVA or EHA valve actuators. Based upon engine timing determined from the crank position sensor (timing detector 44), the controller 38 selects which valve(s) to be monitoring through Valve Select. There is a one-dimensional table used by the controller 38 to map the accelerometers 42 to the given valve 10. This table outputs the Valve Select to the multiplexer block 46 which selects the accelerometer (1, 2 . . . N) for processing for that valve (1, 2 . . . N). If more than one knock sensor 40 is used (not shown) then the table can include mapping information for which sensor is used for which valve.

The controller 38 also estimates the valve closing position of the valve(s) currently subject to monitoring by the processing blocks shown. This estimated valve closure position is based upon the drive commands to the valves, previously determined valve closure positions measured from these blocks, and the crankshaft position sensor, CPS (44). The CPS sensor is used to determine crankshaft angle position for measurement window generation 54 and interpolation in the peak detector 50. The window generation block 54 can generate multiple enable windows with individual programmable timing advances relative to estimated valve closure produced by the controller 38 and durations. The enable windows generated can be used to isolate the signal for peak detection; measure the energy of the signal during a period when a reference value can be determined for normalizing the signal; and to measure the energy of the signal during the impact of the valve, wherein the latter can be adapted in real-time based upon the peak location determined by the controller 38.

By adjusting the windows relative to an estimated valve closure, the window position can be narrowed and adapted to improve the signal to noise. Tests have confirmed that window durations of 5° and narrower can be used. The output of the multiplexer 46 is the multiplexed accelerometer signal. This output can optionally be filtered 48 by an anti-aliasing filter to remove out-of-band signals to improve signal to noise. The multiplexed and filtered signal is then converted from an analog signal to a digital signal by an analog-to-digital converter which can be further processed by an infinite-impulse-response or finite-impulse-response filtering. For example, determining the location and amplitude of the peak for valve closure can be enhanced by finite-impulse-response filtering, and determining the signal energy and a reference signal strength for normalization can be enhanced by either infinite-impulse-response or finite-impulse-response filtering In particular, determining the location of valve closure can begin with a digital filter that is preferably an FIR filter with linear phase delay and constant time delay to enable correction of the location of valve closure by the filter delay. After the digital filter, the signal is rectified. (Optionally, this rectification could be eliminated and the maximum and minimum location in the peak detection block be used. This may improve the determination of valve closure by examination of the sign and magnitude of the peak as the valve closure should consistently provide, at a given condition, a repeatable signature of acceleration). The peak detector 50 has inputs of the conditioned accelerometer signal and window enable signal 54. The location and amplitude of the peak is then determined. The peak is the maximum of the input signal during the measurement window. Optionally, the peak can be normalized. The location of the peak is determined by interpolation from the start and end of the window. The location of the valve closure can also be corrected for the signal processing delay (of which the filter is a major contributor), and output to the controller 38 for use in closed loop control of the valve.

The same filter 48 and peak detection 50 blocks can be used to process the knock signal from the sensor 40. In this case, the filter 48 can isolate the signal due to the valve closure and remove extraneous noise sources such as vibration caused by combustion knock. The signal can be rectified (and optionally it can be squared) for processing. If linearization is desired, integration of the signal can also be done during two window periods to normalize the energy and peak signals. The integration is averaged on a per sensor basis to remove event-to-event based variability in the reference measurement. Further, the output of the integration can be normalized by a valve specific normalization value, which can then be used as an input to the closed loop control of the valve.

Alternatively or in conjunction with the above normalization, the signals maybe normalized or calibrated by activating the valves before the start of engine rotation or at low engine rotation speeds (such as cranking). The above outputs can be used in conjunction with estimation and calculation techniques and timing detector as a diagnostic and or to improve the performance of the system when used in conjunction with the other indirect measurement techniques.

Multi-axis accelerometers maybe used to improve signal and separation between valve generated signal and other sources of signal. Signals from the two or more axes may be processes as above or the signals may be combined and processed as a vector signal (magnitude and direction).

In operation, the processing for the location of valve closing and for the impact energy occur in parallel. Alternatively, the processing for the location of valve closing could be performed first and then this location could be used to determine the window location. Buffering of the signal would then be used so that these calculations could be performed in series.

Figure 7:
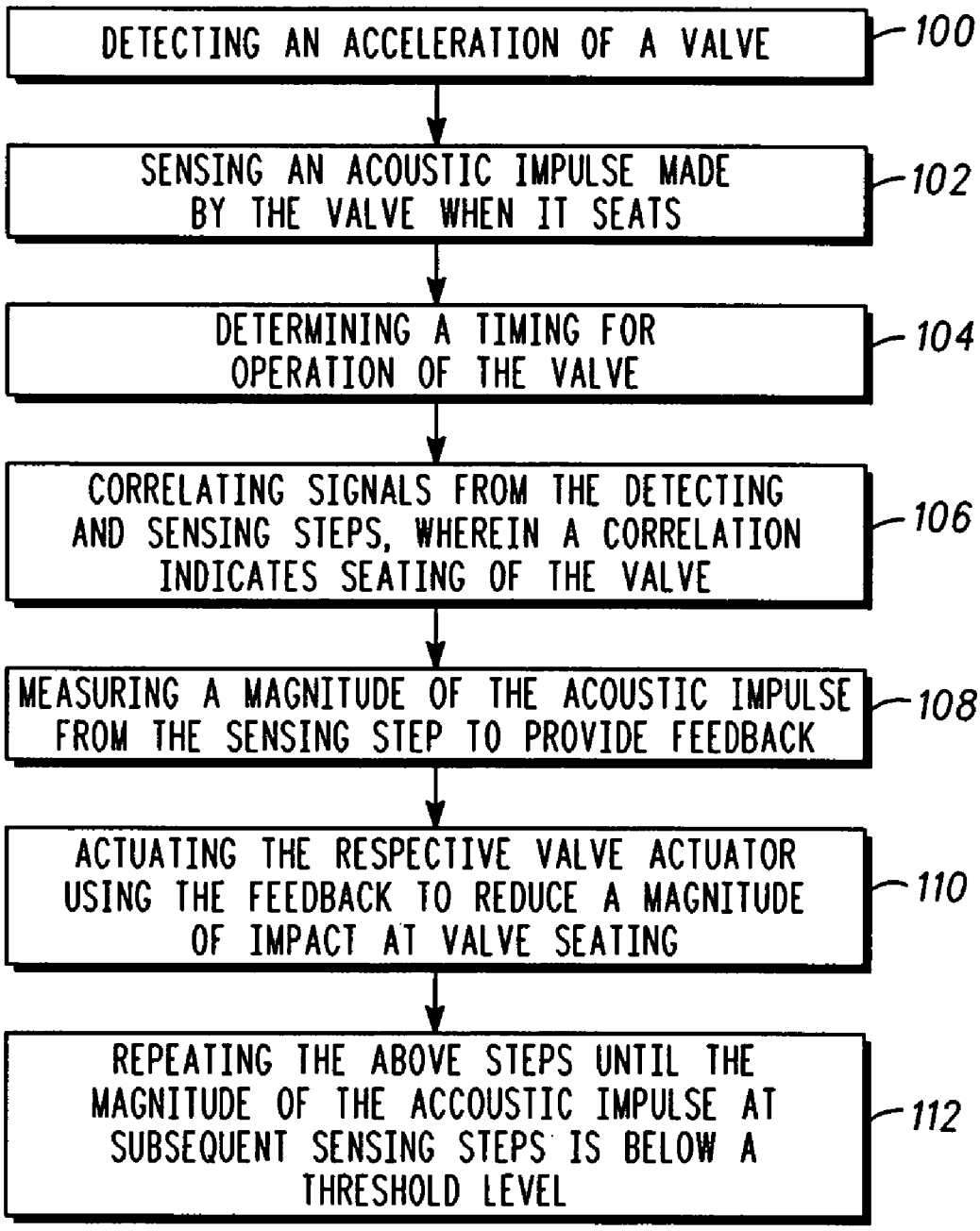
FIG. 7 is a flow chart showing a method, in accordance with the present invention.

The present invention also includes a method for operating a plurality of valves in an engine driven by respective valve actuators. Referring to FIG. 7, the method includes a first step 100 of detecting an acceleration of each of the respective plurality of valves. Preferably, this step includes multiplexing the acceleration signals onto a common signal line.

A next step 102 includes sensing an acoustic impulse made by the valves when they seat.

A next step 104 includes determining a timing for operation of the valves.

A next step 106 includes correlating signals from the detecting and sensing steps, wherein a signal from the sensor that correlates in time with a signal from an accelerometer indicates seating of the respective valve. In particular, the correlating step 106 provides correlation of the signals from the sensor and accelerometer during a timing window about a predetermined timing point when the valve is to seat. This step can also include measuring a characteristic frequency of the acoustic impulse to further discriminate a valve seating from extraneous noise.

A next step 108 includes measuring a magnitude of the acoustic impulse from the sensing step to provide feedback. A magnitude of an acoustic impulse measured above a threshold level indicates an unacceptably harsh closure of the valve. A magnitude of an acoustic impulse measured above a second threshold level indicates an unacceptably harsh closures of at least two valves simultaneously.

A next step 110 includes actuating the respective valve actuator using the feedback from the measuring step in a way to reduce a magnitude of impact at valve seating. This step includes decreasing the rate of movement of the valve at seating to reduce seating impact.

A next step 112 includes repeating the above steps until the magnitude of the acoustic impulse at subsequent sensing steps is below a threshold level.

EXAMPLE

Tests were conducted to determine the effect of the present invention using variable cam timing (VCT) V6 engine to obtain the data discussed below. The engine was firing during the data acquisition. Data was obtained from instrument grade accelerometers at a 200 KHz sample rate to provide a high fidelity signal. The results below were obtained by implementation of the basic peak detection algorithm as described herein.

For each engine and operating condition the occurrence of valve closing for the most recent event was continuously predicted and detected.

Figure 3:
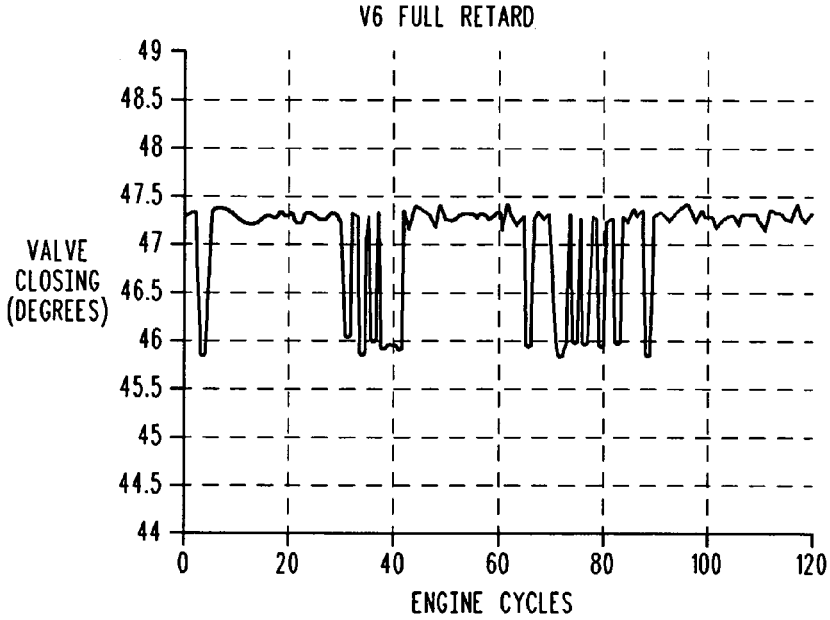
FIG. 3 shows a graphical representation of an first test of a V6 engine, in accordance with the present invention.

FIG. 3 shows the results for the V6 engine under full timing retard. The window for detection was 30–60° ATDC. The calculated peaks occur at about 47.1° ATDC. As can be seen, the present invention detected valve closure near 47° after top-dead-center (ATDC) a large majority of the time, with occasional noise detections at 46°. These results indicate that the present invention correctly determines the closing angle to 0.5° standard-deviations. The window start and stop positions (degrees), filter frequencies (Hz), accelerometer and valve used, valve closure mean and standard deviation (degrees) are listed in FIG. 5. As can be seen, appropriate filtering and/or windowing of +/−1.0° would provide very accurate results. The intake valve closure was advanced by 30° and the test was repeated.

Figures 4, 5, 6:
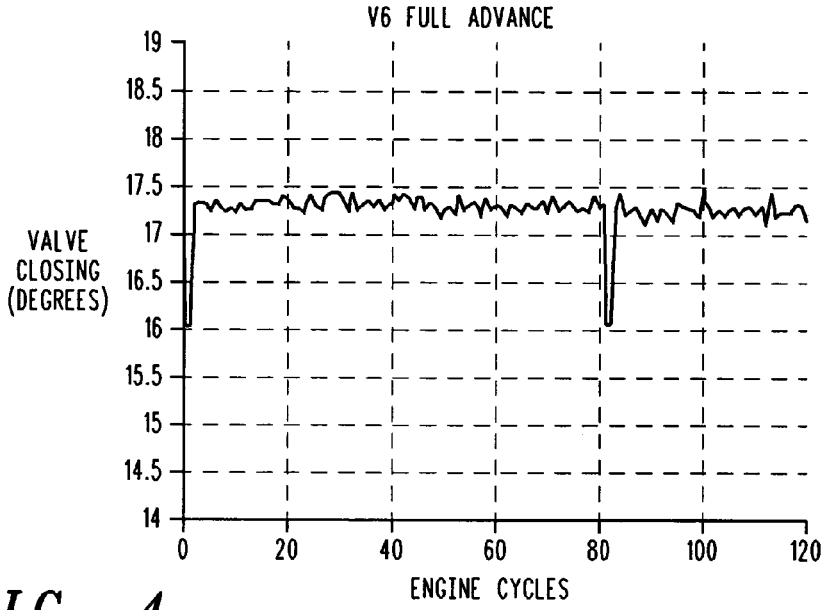
FIG. 4 shows a graphical representation of a second test of a V6 engine, in accordance with the present invention.
FIG. 5 shows a table of statistics for the graph of FIGS. 3 and 4.
FIG. 6 shows a table of statistics for a V8 engine, in accordance with the present invention.

FIG. 4 shows the reported intake valve closing event from the peak detector. The window for detection was 0–30° ATDC. The calculated peaks occur at about 17.3° ATDC. As can be seen, the present invention detected valve closure near 17° after top-dead-center (ATDC) a large majority of the time, with only one noise detected at 16°. The present invention was able to detect the 30° valve closure shift. These results indicate that the present invention again correctly determines the closing angle to 0.5° standard-deviations. The window start and stop positions (degrees), filter frequencies (Hz), accelerometer and valve used, valve closure mean and standard deviation (degrees) are listed in FIG. 5.

Similar results were obtained for both banks of cylinders. Tests were also conducted for a variable cam timing (VCT) V8 engine with significantly improved results. The window start and stop positions (degrees), filter frequencies (Hz), accelerometer and valve used, valve closure mean and standard deviation (degrees) are listed for the V8 engine in FIG. 6.

While the present invention has been particularly shown and described with reference to particular embodiments thereof, it will be understood by those skilled in the art that various changes may be made and equivalents substituted for elements thereof without departing from the broad scope of the invention. In addition, many modifications may be made to adapt a particular situation or material to the teachings of the invention without departing from the essential scope thereof. Therefore, it is intended that the invention not be limited to the particular embodiments disclosed herein, but that the invention will include all embodiments falling within the scope of the appended claims.

What is claimed is:

1. An apparatus for operating a plurality of valves in an engine, the apparatus comprising:

a plurality of valve actuators coupled to the plurality of valves, each valve actuator operable to move a respective valve, a plurality of accelerometers operable to detect an acceleration of the respective plurality of valves;

a knock sensor operable to detect an acoustic impulse made by the valves when they seat; and a controller coupled to the valve actuators, accelerometers and sensor, the controller correlates signals from the sensor and accelerometers, wherein a signal from the sensor that correlates in time with a signal from an accelerometer indicates seating of the respective valve, which indicates a closure of the respective valve, and wherein the controller measures an magnitude of the acoustic impulse to be used as feedback in controlling the operation of the respective valve actuator, wherein a magnitude of an acoustic impulse that is measured above a second threshold level indicates closures of at least two valves at substantially the same time.

2. The apparatus of claim 1 wherein the controller measures energy of a plurality of signals from the knock sensor during periods when reference values can be determined and averages the reference values for normalizing the acoustic impulse by the knock sensor.

3. The apparatus of claim 1, further comprising a timing detector being coupled to the controller, wherein the controller only provides correlation of the signals from the sensor and accelerometer during a timing window about a predetermined point when the valve is to seat.

4. The apparatus of claim 1, wherein the controller measures a characteristic frequency of the acoustic impulse to further discriminate a valve seating from extraneous noise.

5. The apparatus of claim 1, wherein the controller decreases the rate of movement of the valve at seating to reduce seating impact and subsequently the magnitude of the acoustic impulse therefrom to below a threshold level.

6. An apparatus for operating a plurality of valves in an engines the apparatus comprising:

a plurality of valve actuators coupled to the plurality of valves, each valve actuator operable to move a respective valve, a plurality of accelerometers operable to detect an acceleration of the respective plurality of valves:

a knock sensor operable to detect an acoustic impulse made by the valves when they seat;

a controller coupled to the valve actuators, accelerometers and sensor, the controller correlates signals from the sensor and accelerometers, wherein a signal from the sensor that correlates in time with a signal from an accelerometer indicates seating of the respective valve, which indicates a closure of the respective valve, and wherein the controller measures an magnitude of the acoustic impulse to be used as feedback in controlling the operation of the respective valve actuator;

a signal line commonly coupled to at least two accelerometers, and a multiplexer coupled to the signal line, wherein the multiplexer multiplexes the signals from the at least two accelerometers to the controller.

7. The apparatus of claim 6, further comprising a timing detector being coupled to the controller, wherein the controller only provides correlation of the signals from the sensor and accelerometer during a timing window about a predetermined point when the valve is to seat.

8. The apparatus of claim 6, wherein the controller measures a characteristic frequency of the acoustic impulse to further discriminate a valve seating from extraneous noise.

9. The apparatus of claim 8 wherein the controller measures a characteristic frequency of the acoustic impulse via one of a finite impulse response filtering technique or an infinite impulse response filtering technique.

10. The apparatus of claim 6, wherein the controller decreases the rate of movement of the valve at seating to reduce seating impact and subsequently the magnitude of the acoustic impulse therefrom to below a threshold level.

11. The apparatus of claim 6 wherein at least one of the accelerometers is a multi-axis accelerometer.

12. The apparatus of claim 6 wherein the controller measures energy of a plurality of signals from the knock sensor during periods when reference values can be determined and averages the reference values for normalizing the acoustic impulse by the knock sensor.

13. A method for operating a plurality of valves in an engine driven by respective valve actuators, the method comprising the steps of:

detecting an acceleration of the respective plurality of valves;

sensing an acoustic impulse made by the valves when they seat;

correlating signals from the detecting and sensing steps, wherein a signal from the sensor that correlates in time with a signal from an accelerometer indicates seating of the respective valve;

measuring a magnitude of the acoustic impulse from the sensing step to provide feedback wherein a magnitude of an acoustic impulse measured above a second threshold level indicates closures of at least two valves; and actuating the responsive valve actuator using the feedback from the measuring step in a way to reduce a magnitude of impact at valve seating.

14. The method of claim 13 further comprising the steps of:

measuring energy of a plurality of signals from the knock sensor during periods when reference values can be determined; and averaging the reference values for normalizing the acoustic impulse.

15. A method for operating a plurality of valves in an engine driven by respective valve actuators, the method comprising the steps of:

detecting an acceleration of the respective plurality of valves;

sensing an acoustic impulse made by the valves when they seat;

correlating signals from the detecting and sensing steps, wherein a signal from the sensor that correlates in time with a signal from an accelerometer indicates seating of the respective valve;

measuring a magnitude of the acoustic impulse from the sensing step to provide feedback; and actuating the respective valve actuator using the feedback from the measuring step in a way to reduce a magnitude of impact at valve seating, wherein the detecting step includes multiplexing the acceleration signals onto a common signal line.

16. The method of claim 15, further comprising a step of determining a timing for operation of the valves, wherein the correlating step only provides correlation of the signals from the sensor and accelerometer during a timing window about a predetermined timing point when the valve is to seat.

17. The method of claim 15, wherein the correlating step includes measuring a characteristic frequency of the acoustic impulse to further discriminate a valve seating from extraneous noise.

18. The method of claim 15, wherein the actuating step includes decreasing the rate of movement of the valve at seating to reduce seating impact, and further comprising the step of repeating the steps until the magnitude of the acoustic impulse at subsequent sensing steps is below a threshold level.

19. The method of claim 15 further comprising the steps of:

measuring energy of a plurality of signals from the knock sensor during periods when reference values can be determined; and averaging the reference values for normalizing the acoustic impulse.

* * * * *